United States Patent [19]

Schaefer

[11] 4,333,249

[45] Jun. 8, 1982

[54] CONVERTIBLE SPORTS DEVICE

[76] Inventor: Hans-Joachim Schaefer, Gymnasiumstrasse 7, D-6380 Bad Homburg, Fed. Rep. of Germany

[21] Appl. No.: 170,806

[22] Filed: Nov. 21, 1980

Related U.S. Application Data

[63] Continuation of Ser. No. 5,697, Jan. 23, 1979, abandoned, which is a continuation of Ser. No. 821,310, Aug. 2, 1977, abandoned.

[51] Int. Cl.[3] ..... A43B 5/04

[52] U.S. Cl. ..... 36/115; 36/61; 36/134

[58] Field of Search ..... 36/115, 134, 61; 272/96

[56] References Cited

U.S. PATENT DOCUMENTS 3,793,751 2/1974 Gordos ..... 36/134

3,979,842 9/1976 Texidor ..... 36/115

3,983,643 10/1976 Schreyer et al. ..... 36/61

*Primary Examiner*—Patrick D. Lawson

*Attorney, Agent, or Firm*—Michael J. Striker

[57] ABSTRACT

A convertible sports device has a housing, and sport members movable between an extended and a retracted position relative to the housing. An arresting member is provided, which in a first position abuts against a first face of each of the sport members so as to arrest them in the extended position, and in a second position abuts against another face of the sport members so as to arrest the latter in the retracted position. The housing may be formed as a bottom portion of a shoe or may be attachable to the shoe. The arresting member may be actuated by an actuator which, in turn, may be actuated by a foot of a user so that the sport members may be retracted or extended without the need to use one's hands.

51 Claims, 8 Drawing Figures

CONVERTIBLE SPORTS DEVICE

This is a continuation of application Ser. No. 005,697, filed Jan. 23, 1979, now abandoned, which in turn is a continuation of application Ser. No. 821,310 filed Aug. 2, 1977 and now abandoned.

BACKGROUND OF THE INVENTION

The present invention relates to a sport device, and particularly, to a sport device with extendable and retractable sport members.

It is well known that sports are necessary for good physical body tone. Sport is needed for well-being of one's health. Some sports which are very conducive to achieve these purposes are running and skating at high speed, such as roller skating, ice skating and the like.

A number of skating devices have been proposed in the art and are in daily use. Attempts have been made to make such sport devices with extendable and retractable sport members. It appears, however, that the known sport devices of the above type are not yet ultimate with respect to their convertibility and strength in an extended or a retracted position. Especially in the extended position the sport members are subject to increased forces whose magnitude depends on the level of activity of the user, on the speed at which he or she moves, and on the weight of the user. Thus, the known sporting devices are quickly worn out at active sports and thereafter lose their reliability. It also happened that competitors lost in competitive sports events due to inadequate functioning, fastening or reliability of their sport devices. The known sports devices do not have means for moving the sport members between the extended and retracted positions without the aid of the hands of the user.

SUMMARY OF THE INVENTION

Accordingly, it is an object of the present invention to provide a sports device with extendable and retractable sport members, which device avoids the disadvantages of the prior art sports devices.

More particularly, it is an object of the present invention to provide a sports device with extendable and retractable sport members, which device assures reliable arresting of the sport members in the extended position, maintaining of a sufficient strength in this position and preventing accidents in said position.

Another object of the present invention is to provide a sports device with extendable and retractable sport members, whose sport members are easily movable between the above two positions, and which device, at the same time, is of a simple construction, inexpensive and easy to manufacture.

Still another object of the present invention is to provide a sports device with extendable and retractable sport members having a housing which is capable to withstand high load, shock and thrust, and has portions of sufficient strength for supporting the associated sport members.

Still a further object of the present invention is to provide a sports device with extendable and retractable sport members which latter can be moved into the respective extended or retracted positions without the aid of the user's hands but, instead, with the aid of his or her other foot.

An additional feature of the present invention is to provide a sport device with extendable and retractable sport members which latter can be easily replaced by other sport members of another type or dimension.

In keeping with these objects, and with others which will become apparent hereinafter, one object of the present invention resides, briefly stated, in a sports device which has means forming a housing, at least one sport member movable relative to the housing between an extended and a retracted position and having two faces spaced from one another, and an arresting member arresting the sport member in each of the above positions. The arresting member is movable between a first position in which it abuts against one of the faces of the sport member and arrests the latter in the extended position, and a second position in which the arresting member abuts against the other face of the sport member and arrests the latter in the retracted position.

In the thus-constructed sports device the arresting member reliably arrests the sport member or sport members in the extended position so that sufficient strength can be maintained and accidents are prevented in this position. The sport members are easily movable between the two positions, and the device is of a simple construction, inexpensive and easy to manufacture.

Another feature of the present invention is that the housing is provided with a recess in which the sport members are received in the retracted position and from which they extend in the extended position. The arresting member is mounted in the housing similarly to the sport members. Such device is capable to withstand high load, shock, thrust, and reliably supports the sport members.

A further feature of the present invention is that the device is provided with a thrust element which can push the arresting member of the device attached to the shoe of another foot of the user so that the respective movement of the arresting element can be performed without the aid of the user's hand. For the same purpose actuating means may be provided which include an actuating member operative for moving the arresting member into the respective positions. By operation of the actuating member which can be actuated by the user's foot, the arresting member can be disengaged from the sport members and thereby the latter can be moved between the extended and retracted positions.

The sport members may be mounted detachably with respect to the housing or with respect to supporting portions of the sport members. In this case the sport members can be replaced by other sport members of different types or dimensions. For instance, rollers of roller skates may be replaced by blades of ice skates, pointed pins, stilts, or higher bottom extensions, and vice versa.

Still a further feature of the present invention is that the housing may be provided with a face, and the respective faces of the housing, the arresting member and the sport members may be flat. It is also possible that the faces of the arresting member and the sport members are at least partially cylindrical. Spring means may be provided for arresting the arresting member in the respective position thereof.

An additional feature of the present invention is that the arresting member may be formed as a bar-shaped member which is received in a respective recess provided in the sport member, in the extended or the retracted position of the latter. The thus-provided interengagement of the arresting member and faces of the recesses of the sport member assures a reliable retention of the sport members in the respective position thereof.

Spring means may be provided for resiliently urging the actuating member so that the latter urges the arresting member into the respective position into engagement with the respective recess, or into abutment against the respective face, or into retention in the respective recess of the sport member.

Still an additional feature of the present invention is that two arresting members may be provided, each operative for arresting the respective one of said sport members. The additional arresting member may be mounted on an insert provided within the housing. It is also possible that only one arresting member is provided, arresting the one of said sport members, in which case the two or more sport members must be connected with each other for joint movement between the extended and retracted positions.

Finally, still a further feature of the present invention is that the sport members are movable between a plurality of positions in a step-by-step or in a stepless manner. The arresting member is operative for arresting the sport members in each of these positions.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERED EMBODIMENTS

Figure 1:
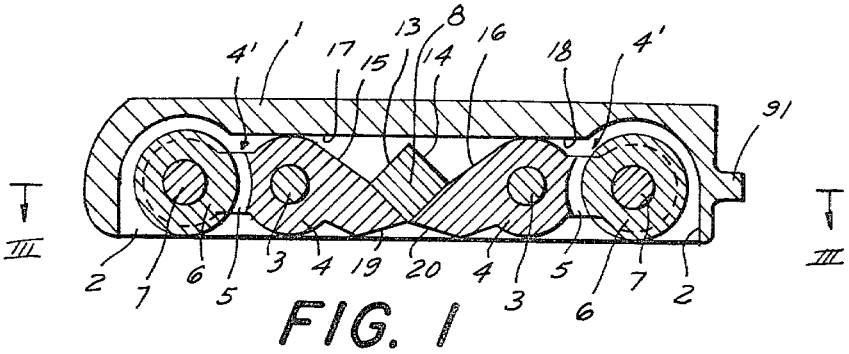
FIG. 1 is a longitudinal sectional view of a sports device in accordance with the present invention, showing sport members of the device in a retracted position.

A sports device in accordance with the present invention is shown in the drawings as embodied in roller skates. However, it is understood that the present invention may be embodied in sports devices of other types.

The device has a housing 1 having two inner recesses 2. The housing may be formed as a lower part of a shoe and of one piece therewith, or may be formed as a separate member attachable to the shoe. The sport members are provided, identified in toto by reference numeral 4' and each having a working portion and a supporting portion. As shown in the drawing, the working portion of each sport member 4' is formed as a roller 6, however, it may be formed as a blade of ice skates, a pointed pin, a stilt element and the like. The supporting portion 4 has a central hole, and a supporting member extends through this cental hole. The supporting member is formed as a pin 3 which has two end portions each located in a hole of the housing 1 so as to provide for pivotal movement of the supporting portion 4 with respect to the housing 1, together with the roller 6.

Each supporting portion 4 has two arms located at the opposite sides of the central hole of the supporting portion. One of said arms 5 serves for supporting of the roller 6 and has a hole through which a pin 7 extends. The latter also extends through two holes formed in each roller 6 so that the roller is pivotally connected with the arm 5 of the supporting portion 4. Each arm 5 may support several rollers 6, and, on the other hand, each roller 6 may be supported by several such arms, if necessary. It is understood that the pins 3 and 7 must be arrested in the housing 1 or in the supporting portions 4. This can be done by bolts, rivets, nuts and the like elements which are known per se in the art and therefore are not shown in the drawing.

Each of the arms 25 of the supporting portions 4 of the sport member 4' is provided with bearing faces 15, 26, 19 and 16, 28, 20, respectively, for the purpose which will be explained hereinafter. The housing 1 is also provided with the two faces 17 and 18 each located adjacent the other arm 25 of the respective supporting portion 4.

An arresting member is further provided, identified in toto by reference numeral 8. The arresting member 8 has two end portions 9 and 10, and a middle portion 8' located between the end portions. The middle portion 8' of the arresting member 8 is provided with four bearing faces 11, 12, 13 and 14. The bearing faces 11, 12, 13 and 14, as well as the bearing faces 15, 16, 19, 20, 26, 28 of the supporting portions 4 of the sport member 4', and the bearing faces 17, 18 of the housing 1 may be flat. However, it is also possible that these faces have another form, such as partially cylindrical. The bearing faces 11, 12, 13 and 14 of the arresting member 8 may extend over substantially the entire length of the middle portion 8' thereof so as to increase bearing ability and stability. It is advantageous when the bearing faces 11, 12, 13 and 14 extend over a length corresponding to one third of the width of the housing 1. The cross-sectional area of the arresting member 8 and the size of the bearing faces thereof must be large enough to withstand the great stresses which are produced when the sports device is used intensively and at a high speed. In these cases the rollers, the housing and the arresting member are subject to extremely great dynamic loads.

The end portions 9 and 10 of the arresting member 8 are received in seats 21 and 22, respectively, which latter are formed in the housing 1. It is preferable to make the end portions 9 and 10 of the arresting member 8 and the seats 21 and 22 of the housing 1 of a cylindrical shape for easy production thereof. One of the end portion of the arresting member 8, such as the end portion 9, may be made of a diameter which is smaller than that of the other portion 10. This facilitates the assembly of the arresting member 8 with the respective parts of the device.

A recess 23 is further formed in the housing 1, and a spring 24 is received in the recess 23. The rear neck 25' of spring 24 is retained by a respective portion of a wall of recess 23 located around the pin 3 or near the latter.

The other portion of the spring 24 may engage with or in a groove 31 provided in the end portion 10 of the arresting member 8. When a force is applied by the user to the spring 24, the latter can move from the portion 10 of the arresting member into the recess 23 so as to release the arresting member 8. In the working position, the spring 24 engages with or in the groove of the arresting member 8 and reliably arrests the latter in the respective position.

The sport members, that is the rollers 6 of the sport device, in accordance with the present invention are moved between the extended and retracted positions in the following manner.

Figure 2:
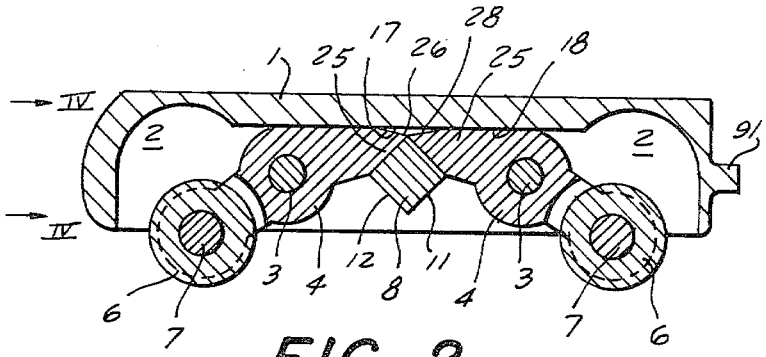
FIG. 2 is a longitudinal sectional view of a sports device in accordance with the invention, showing sport members of the device in an extended position.
Figure 4:
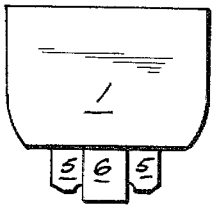
FIG. 4 is a front view of the sports device shown in FIG. 2.

For movement of the rollers 6 from the extended position shown in FIG. 2 of the drawing into retracted position shown in FIG. 1, the arresting member 8 is withdrawn by hand at least partially from the housing 1 by movement of the arresting member 8 in the direction of elongation of the latter. Under the action of a weight of the user standing on the device, the supporting portions 4 and the rollers 6 connected therewith are turned about the axes and inserted into the recesses 2 of the housing 1. In this position the arresting member 8 is moved backwardly in the direction of elongation thereof and is fully inserted by hand in the housing 1. The arresting member 8 is supported by the seats 21 and 22 of the housing and retained by the spring 24. The bearing faces 13 and 14 of the arresting member 8 abut against the bearing faces 26 and 28 of the arms 25 of the supporting portions 4 of the respective sport members 4. The supporting portions 4 and the rollers 6 are then located within the housing and firmly arrested in this position by the arresting member 8.

For movement of the rollers 6 from the retracted position into the extended position shown in FIGS. 1 and 2, respectively, the arresting member must be again at least partially withdrawn from the housing 1. The shoe of the user with the housing 1, either formed as one piece with the shoe or connected therewith, must be lifted. Under the action of their own weight the rollers 6 and the supporting portions 4 are turned about the axis and extended outwardly beyond the housing 1 until the bearing faces 15 and 16 of the arms 25 of the supporting portions 4 will abut against the bearing faces 17 and 18 of the housing 1. In this position the arresting member is again reinserted in the housing 1 by movement of the same in the reverse direction and may again be arrested by the spring 24. The bearing faces 13 and 14 of the arresting member abut against the bearing faces 19 and 20 of the arms 25 of the supporting portions 4 of the sport members 4'. The supporting portions 4 are firmly supported by the arresting member 8 from below and the rollers 6 are reliably arrested in the extended position.

The housing 1 may be provided with a thrust member 91 extending forwardly from the housing. With the aid of this thrust member, the user can push end portion 9 of the arresting member 8 of the device attached to the shoe of the one foot of the user, by the thrust member 91 of the device attached to the shoe of his other foot. Thus, the arresting member 8 may be moved out of and into the housing 1 without the aid of the hands of the user particularly if corrosion or dust is present.

Figure 3:
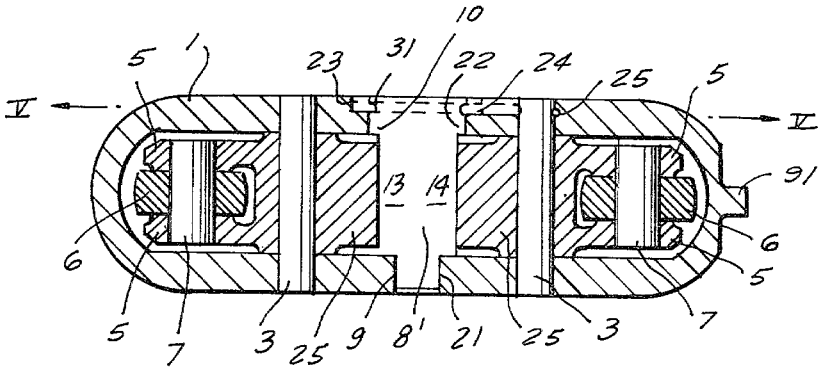
FIG. 3 is a plan sectional view of a sports device taken along the line III—III of FIG. 1.
Figure 5:
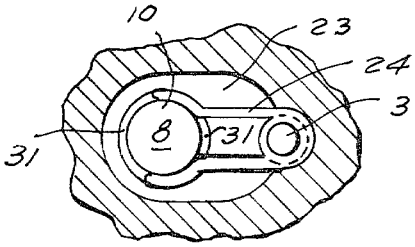
FIG. 5 is a fragmentary sectional view of a sports device taken along the line V—V of FIG. 3.
Figure 6:
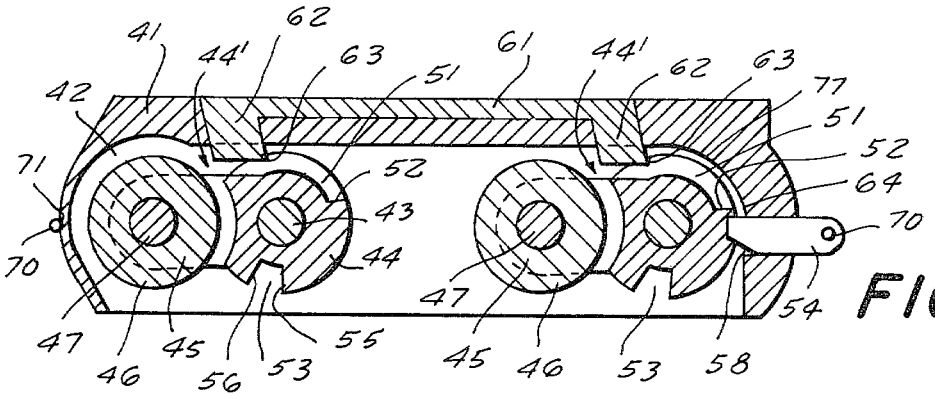
FIG. 6 is a longitudinal sectional view of a sports device in accordance with another embodiment of the present invention, showing sport members in a retracted position.
Figure 7:
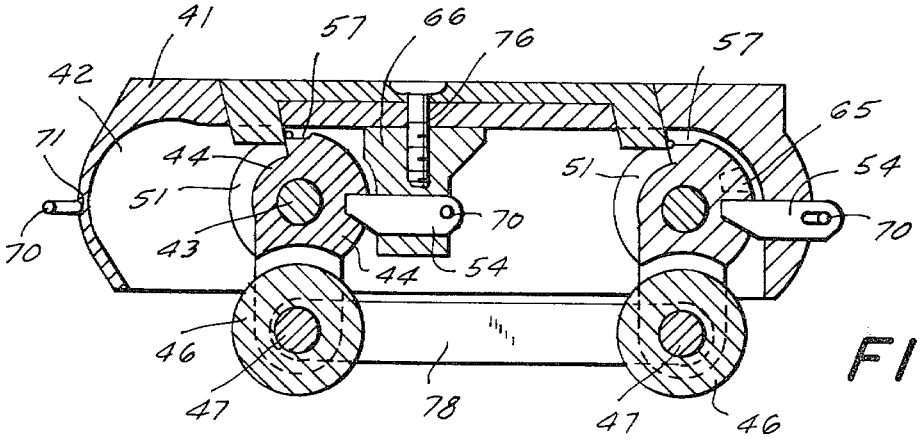
FIG. 7 is the same section of a sports device in accordance with the above other embodiment, but showing the sport members in an extended position.
Figure 8:
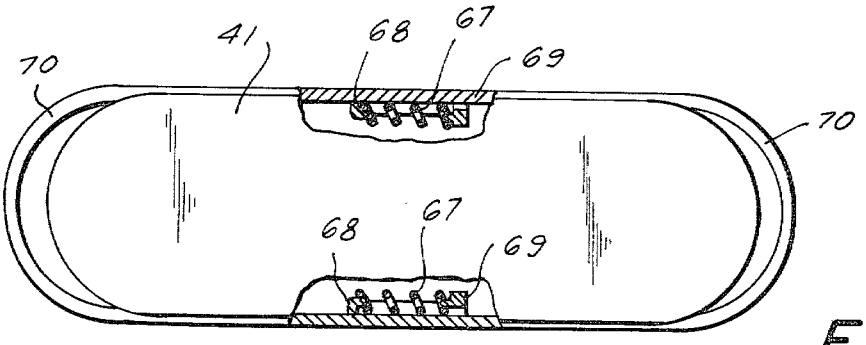
FIG. 8 is a fragmentary plan view of the sports device shown in FIG. 6, which is taken along the line VIII—VIII of FIG. 6 and shows an actuating member of the device.

FIGS. 6–8 show another embodiment of the present invention. The device in accordance with this embodiment has a housing 41 having two inner recesses 42. Two sport members are provided, identified in toto by reference numeral 44' and each having a working portion and a supporting portion. The working portions of the sport members are formed as rollers 46, whereas the supporting portions each have an arm 45 for supporting the roller 6 and a central portion 44 supported by a pin 43. Similarly to the device shown in FIGS. 1–3, the rollers 46 are connected with the arms 45 by pins 47 so as to provide for pivotal movement of the rollers, and the pins 43 which support the central portions 44 of the sport members are mounted in the housing 1 so as to provide for the movement of the sport members between the extended and retracted position shown in FIG. 7 and FIG. 6, respectively.

An arresting member 54 is provided at a rear end of the housing 41 and is slidable forwardly and rearwardly lengthwise its axis. An arresting member, similar to the first-mentioned arresting member 54 may be mounted on an insert member 66 as shown in FIG. 6. At least one of the central portions 44 of the sport members 44' is provided with a small arresting recess 57 and with a main arresting recess 53. The central portion 44 of the other sport member 44' may not be provided with the similar arresting recess 57, and the arresting member 54 may not be associated with this sport member, in which case connecting bar 78 or similar connecting member must connect the sport members for joint movement with one another as shown in FIG. 7. Such connecting bar 72 may connect the pins 47 of the rollers 46.

The central portion 44 of each supporting portion of the sport members has also a further main arresting recess 51 with an arresting face 52 at one end of the latter. An arresting bar 61 is mounted in the housing 41 and has two arresting portions 62, each having an arresting end face 63. The arresting portions 62 extend into the main arresting recesses 61 of the central portions 44 of the sport members 44'.

An actuating member 70 is provided, which is loaded by a spring. Spring retaining portions 69 are located in the housing 41 to bear spring member 67, while the latter are borne and compressed on their other ends by spring holders 68 of the actuating member 70. Similarly to the housing shown in FIGS. 1–3, the housing 41 may be formed as a lower part of a shoe and of one piece therewith, and also may be formed as a separate member attachable to the shoe. As shown in the drawing, the actuating member 70 extends through a hole in the arresting members 54. However, the actuating member 70 may be connected with the arresting member in another suitable manner.

The sport member, that is the roller 46, in accordance with the other embodiment of the present invention, are moved between the extended and retracted positions in the following manner.

For movement of the rollers 46 from the extended position shown in FIG. 7 into the retracted position shown in FIG. 6, the user moves a respective foot with the shoe thereon downwardly and thrust a front portion of the actuating member 70 against the surface on which the user stands. Under the action of the above thrust the actuating member 70 moves rearwardly lengthwise the longitudinal axis of the shoe and thereby withdraws the arresting members 54 from the arresting recesses 53. The supporting portions of the sport members 44' move downwardly under the action of the applied force and of their own weight. Thus, the sport members 44' move inwardly of the recesses 42 of the housing 41. If the sport member 44' does not completely enter the housing 41, the user's foot may be thrust against the ground substantially parallel to the latter, and thereby the supporting portions will further be urged into the 41 so that they will be fully inserted therein. The sport member 44' is retained in the retracted position either by the action of the arresting spring force of the actuating member 70 applied to the arresting member 54, or by arresting of the arresting member 54 in the recess 57.

For movement of the sport members from the retracted position shown in FIG. 6 into the extended position shown in FIG. 7, the rear part of the shoe thrusts against the shoe or the housing 41 of the other foot so that the actuating member 70 moves rearwardly relative to the longitudinal axis of the shoe. The arresting member is thereby withdrawn from the arresting recess 57, and thereby the supporting portions and the rollers 46 move outwardly of the housing 41. When the sport members 44' are fully pivoted downwardly relative to the housing 41, the actuating member 70 urges the arresting members 54 into the arresting recesses 53, and thereby the sport members 44' are arrested in the extended position thereof. The reliable retaining of the arresting members 54 in the recesses 53 is assured by arresting faces 64 and 58 provided on the arresting members, which faces may be inclined relative to one another. Additional arresting faces 56 and 55 may be provided in the central portions 44 of the supporting portions of the sport members 44'. The dimensions and directions of the faces 55, 56, 58 and 64 are selected so as to provide for unimpeded withdrawal of the arresting members from the recesses and realiably retaining the arresting members in the latter, when necessary.

The central portions 44 of the supporting portions of the sport members 44' are made of such a diameter that they fit substantially closely in the respective faces of the housing 41, so that a bearing force of the pins 43 is minor as compared with that of the outer faces of the central portions 44. A small clearance between the outer faces of the central portions 44 and the respective faces of the housing 41 also assures an undeformable rigid seat and force of the arresting members 54.

While the upper arresting faces 64 and 55 of the arresting member 54 and the central portion 44 are shown as almost vertical, it is preferable when they are slightly downwardly inclined. This assures that the thrust force of the actuating member 70 under the load of the springs 67 urges the arresting member 54 to the left in FIG. 7, whereby the above slight inclination urges the arresting face 55 of the recess 53 of the central portion 44 of the sport member 44' upwardly in FIG. 7. The thus-produced upward force assures that the face 52 of the recess 51 in the central portion 44 of the sport member 44' abut firmly and closely against the arresting faces 63 of the support members 62. Thus, the faces 63 and 52 together with the face 55 and the thrust force of the face 64 assure sufficient retaining and arresting of the central portions 44 between the above faces without a clearance. An annular groove 71 may be provided in an outer surface of the housing 41 for receiving the actuating member 70 therein.

The sports device in accordance with the second embodiment of the present invention provides for extending and retracting the sport members without the aid of the user's hands. The movement of the sports members from the retracted into the extended position and, therefore, the conversion of a walking shoe into a sporting shoe may be performed in an upright position of the user's body.

The sport members 44' may be mounted detachably with respect to the housing of the sports device, and the working portions of the sport members may be mounted detachably relative to the supporting portions thereof. In this case the working portions of the sport members or the sport members in toto can be replaced by other working portions or sport members, respectively. For instance, the rollers may be replaced by blades of ice skates, pointed pins or the like.

In accordance with a further embodiment of the present invention the sport members 44' may be movable between a plurality of positions and arrestable in each of these positions so that e.g. the rollers are inclined relative to the housing at different angles. For these purposes, a plurality of recesses may be provided in the central portion 44 of the sport member 44', such as including an additional recess 65 shown in FIG. 7 by dotted lines. The arresting member can be inserted into the additional recess 65, in which position the sport member 44' will be inclined relative to the housing 41 and to the ground at an angle differing from the angle at which the sport member 44' is inclined when the arresting member 54 is inserted into the recess 53. When the central portion 44 includes a plurality of such recesses 65, the sport member 44' may be located in the extended position at a plurality of angles.

While the above construction provides for a step-by-step change of the inclination or extension of the sport members 44, it is also possible to provide for a stepless inclination or extension of the latter. For this purpose, the arresting member 54 may be replaced by a screw member which may be inserted in a threaded hole of the housing 41 so as to act as a screw. Such screw member can thrust against any section of the outer surface of the central portion 44 and thereby arrest the sport member 44' in any desirable position thereof. The above screw member is known per se in the art and is not shown in the drawing.

It will be understood that each of the elements described above, or two or more together, may also find a useful application in other types of constructions differing from the types described above.

While the invention has been illustrated and described as embodied in a convertible sports device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a sports device, a combination comprising means forming a housing;

at least one sport member movable relative to said housing between an extended and a retracted position, and having two faces spaced from one another; and arresting means including an arresting member movable between a first position in which said arresting member abuts against and is in surface contact with one of said faces of said sport member so as to arrest the latter in said extended position, and a second position in which said arresting member abuts against and is in surface contact with the other face of said sport member so as to arrest the latter in said retracted position.

2. The combination as defined in claim 1, wherein said means forming said housing include a shoe.

3. The combination as defined in claim 1, wherein said housing has a recess, said sport member being extendable from and retractable into said recess of said housing.

4. The combination as defined in claim 1, wherein said sport member has a working portion and a supporting portion connected with said working portion and supporting the latter, said supporting portion being formed as an arm pivotable about an axis so as to move said working portion between said extended and retracted positions.

5. The combination as defined in claim 4, wherein said faces are formed in said supporting portion of said sport member.

6. The combination as defined in claim 1, wherein said arresting member is mounted in said housing.

7. The combination as defined in claim 6, wherein said arresting member is detachably mounted in said housing.

8. The combination as defined in claim 1; and further comprising second such sport member spaced from said first-mentioned sport member, said arresting member being located intermediate said sport members and simultaneously arresting both of them in the respective positions.

9. The combination as defined in claim 8, wherein said faces of said sport member are substantially flat.

10. The combination as defined in claim 1, wherein said arresting member has two faces each abutting against the respective face of said sport member, said faces of said arresting member being substantially flat.

11. The combination defined in claim 9, wherein said housing has a portion provided with a substantially flat face, said sport member having an additional substantially flat face abutting against said face of said housing in said extended position.

12. The combination as defined in claim 1, wherein said arresting member has two faces each abutting against the respective face of said sport member in the respective position thereof, said faces of said arresting member and said sport member being at least partially of a cylindrical shape.

13. The combination as defined in claim 5, wherein said arresting member has two faces each abutting against the respective face of said supporting portion of said sport member, said faces of said arresting member and said supporting portion of said sport member extending for a length corresponding to substantially one third of the width of said housing.

14. The combination as defined in claim 4; and further comprising shaft means mounting said supporting portion of said sport member for pivotal movement thereabout and including a shaft member mounted in said housing.

15. The combination as defined in claim 4, wherein said working and supporting portions are formed as separate members detachably connected with one another.

16. The combination as defined in claim 1, wherein said sport member is a roller of a roller skate.

17. The combination as defined in claim 1; and further comprising further arresting means for arresting said arresting member in said first and second positions thereof, said further arresting means being arranged in said housing and engaging said arresting member in the respective position thereof.

18. The combination as defined in claim 17, wherein said further arresting means include a spring.

19. The combination in a sport device as defined in claim 2, for use with a similar sport device whose housing includes another shoe of the same pair, the combination further including a thrust portion provided on said housing and adapted to push the arresting member of the other sport device into said first and second positions.

20. The combination as defined in claim 5, wherein said arresting member is elongated and having a central portion provided with two seats each abutting against the respective face of said supporting portion of said sport member, said arresting member having two end portions located at both sides of said central portions and being of a cylindrical shape of different cross-sectional areas, said housing having two cylindrical seats each for receiving therein the respective one of said cylindrical end portions of said arresting member.

21. The combination as defined in claim 18, wherein said housing has a wall bounding a recess and said arresting member is provided with a groove, said spring being received in said recess of said wall of said housing and engaging in said groove of said arresting member.

22. The combination as defined in claim 21, wherein said sport member being pivotable between said extended and retracted positions about an axis, said axis being defined by a shaft member mounted in said wall of said housing, said spring being retained between said shaft member and said wall of said housing.

23. The combination as defined in claim 1; and further comprising actuating means operative for moving said arresting member between said first and second positions thereof with the aid of the user's foot.

24. The combination as defined in claim 1, wherein said arresting member is a bar-shaped member.

25. The combination as defined in claim 1, wherein said sport member has a middle portion pivotable about an axis and a working portion connected to said middle portion for joint pivoting between said extended and retracted positions, said faces of said sport member being formed on said middle portion thereof.

26. The combination as defined in claim 25, wherein said middle portion of said sport member has at least two recesses each formed with the respective one of said faces.

27. The combination as defined in claim 26, wherein said arresting member has a portion provided with two faces and is operatively received in the respective one of said recesses of said sport member in the respective position of said arresting member so that the respective face of the latter abuts against the face of the respective recess.

28. The combination as defined in claim 27, wherein said recesses each have end portions, each of said faces of said recess being formed in the end portion of the respective recess.

29. The combination as defined in claim 27, wherein said arresting member has an axis, and said faces of said arresting member being inclined relative to said axis thereof.

30. The combination as defined in claim 25, wherein said sport member being movable between a plurality of positions, said middle portion having a plurality of such recesses provided with such faces, said arresting member being movable between a plurality of further positions so that in the respective one of said further positions said arresting member engages in the respective one of said recesses and abuts against the respective face thereof so as to arrest the sport member in the respective position.

31. The combination as defined in claim 30, wherein said recesses of said middle portion of said sport member are spaced from each other so that when said arresting member is received in different ones of said recesses said sport member is inclined relative to said housing at different angles.

32. The combination as defined in claim 25, wherein said arresting member is movable relative to said middle portion of said sport member and is resiliently urged in the direction towards said medial portion and into abutment against said faces of the latter.

33. The combination as defined in claim 26, wherein said arresting member is movable relative to said middle portion of said sport member and is resiliently urged in the direction towards said middle portion and into engagement in said recesses of the latter.

34. The combination as defined in claim 1, wherein said actuating means include an actuating member connected with said housing and operatively associated with said arresting member so as to move the latter between said first and second positions.

35. The combination as defined in claim 34, wherein said actuating member extends outwardly beyond said housing so as to be readily accessible for urging by the user and thereby actuating said actuating member.

36. The combination as defined in claim 35, wherein said actuating member is readily accessible by a foot of the user.

37. The combination as defined in claim 35, wherein said housing has a front end and a rear end spaced from one another, said actuating member partially forwardly extending beyond said front end of said housing.

38. The combination as defined in claim 34, wherein said arresting member has a portion provided with a hole, and said actuating member having a section extending through said hole of said portion of said arresting member.

39. The combination as defined in claim 35, wherein said sport member has a middle portion pivotable about an axis and a working portion connected with said middle portion for joint pivoting between said extended and retracted positions, said middle portion having two recesses each formed with the respective one of said faces, said arresting member being received in the respective recess while being in the respective one of said first and second positions thereof, said actuating member being operative for disengaging said arresting member from the respective recess of said middle portion of said sport member when said actuating member is thrusted by the user.

40. The combination as defined in claim 35, wherein said sport member has a middle portion pivotable about an axis and a working portion connected with said middle portion for joint pivoting therewith between said extended and retracted position, said middle portion having two recesses each formed with the respective one of said faces, said arresting member being received in the respective one of said recesses while being in the respective one of said first and second positions thereof; and further comprising spring means resiliently urging said actuating member so that the latter urges said arresting member into each of said recesses of said middle portion of said sport member in the respective position of the latter.

41. The combination as defined in claim 35, wherein said sport member has a middle portion pivotable about an axis and a working portion connected with said middle portion for joint pivoting therewith between said extended and retracted positions, said faces being formed on said middle portion; and further comprising spring means resiliently urging said actuating member so that the latter urges said arresting member towards each of said faces of said middle portion of said sport member in the respective position of the latter.

42. The combination as defined in claim 35, wherein said sport member has a middle portion pivotable about an axis and a working portion connected with said middle portion for joint rotation therewith between said retracted and extended positions, said middle portion having two recesses each formed with the respective one of said faces, said arresting member being received in the respective one of said recesses in the respective one of said first and second positions thereof; and further comprising spring means resiliently urging said actuating member so that the latter holds said arresting member in the respective recess in the respective position.

43. The combination as defined in claim 35; and further comprising spring means for urging said actuating member so that said arresting member is urged into operative engagement with said sport member, said spring means including a spring member which has two spaced end portions connected with said actuating member and said housing, respectively.

44. The combination as defined in claim 27; and further comprising a second such sport member, and a second such arresting member operatively associated with said second sport member.

45. The combination as defined in claim 44, wherein said housing has a wall bounding an inner recess; and further comprising an insert member located in said inner recess and supporting said second arresting member.

46. The combination as defined in claim 45, wherein said insert member has a hole, said second arresting member being received in said hole of said insert member.

47. The combination as defined in claim 26; and further comprising such second sport member; and further comprising means connecting said first-mentioned sport member with said second sport member for joint movement between said extended and retracted positions.

48. The combination as defined in claim 47, wherein said connecting means includes a connecting bar having two end portions, each connected to said first-mentioned and said second sport member, respectively.

49. The combination as defined in claim 1, wherein said sport member is movable steplessly between a plurality of positions, said arresting member being operative for arresting said sport member in each of said positions.

50. The combination as defined in claim 1, wherein said sport members are detachably mounted in said housing.

51. In a sports device, a combination comprising means forming a housing; at least one sport member having three faces and movable relative to said housing between a retracted position and an extended position; and arresting means including an arresting member having two faces, said arresting member being movable between a first position in which a first of said faces of said sport member abuts against and is in surface contact with a first of said faces of said arresting member so that sport member is arrested in said retracted position thereof, and a second position in which a second of said faces of said sport member abuts against and is in surface contact with a second of said faces of said arresting member, and a third of said faces of said sport member abuts against and is in surface contact with a portion of said housing so that said sport member is arrested in said extended position thereof.

* * * * *